US008545131B2

(12) United States Patent
Shelton

(10) Patent No.: US 8,545,131 B2
(45) Date of Patent: Oct. 1, 2013

(54) WATER-SAVING LOCK CONFIGURATIONS AND OPERATIONS

(76) Inventor: Bert Gustav Shelton, Houston, TX (US)

( * ) Notice: Subject to any disclaimer, the term of this patent is extended or adjusted under 35 U.S.C. 154(b) by 272 days.

(21) Appl. No.: 12/747,292

(22) PCT Filed: Jan. 21, 2009

(86) PCT No.: PCT/US2009/031539

§ 371 (c)(1),
(2), (4) Date: Jun. 10, 2010

(87) PCT Pub. No.: WO2009/099761

PCT Pub. Date: Aug. 13, 2009

(65) Prior Publication Data

US 2010/0260549 A1 Oct. 14, 2010

Related U.S. Application Data

(60) Provisional application No. 61/063,434, filed on Feb. 4, 2008.

(51) Int. Cl.
*E02C 1/00* (2006.01)

(52) U.S. Cl.
USPC ..... 405/85

(58) Field of Classification Search
USPC ..... 405/84, 85; 137/571, 265, 255, 137/256
See application file for complete search history.

(56) References Cited

U.S. PATENT DOCUMENTS

| | | | | | |
|---|---|---|---|---|---|
| 737,968 | A * | 9/1903 | Schnapp | 405/85 |
| 872,082 | A * | 11/1907 | Pumberger | 405/85 |
| 1,530,394 | A * | 3/1925 | Muller | 405/85 |
| 1,605,888 | A * | 11/1926 | Beaubien et al. | 405/85 |
| 2,021,345 | A * | 11/1935 | Adams, Jr. | 405/85 |
| 2,103,871 | A * | 12/1937 | Rothmund | 405/86 |
| 4,310,769 | A * | 1/1982 | Mazzone et al. | 290/54 |
| 5,013,184 | A * | 5/1991 | Omachi | 405/85 |
| 7,168,442 | B1 * | 1/2007 | McRobert | 137/209 |
| 2002/0119010 | A1 * | 8/2002 | Len-Rios | 405/85 |
| 2008/0038062 | A1 * | 2/2008 | Allonca | 405/85 |

FOREIGN PATENT DOCUMENTS

| | | | |
|---|---|---|---|
| JP | 10-266177 | A | 10/1998 |
| JP | 2003-55939 | A | 2/2003 |
| KR | 10-2003-0019520 | | 10/2004 |
| KR | 10-2004-0066772 | | 3/2006 |

* cited by examiner

*Primary Examiner* — Thomas B Will
*Assistant Examiner* — Patrick Lambe
(74) *Attorney, Agent, or Firm* — Woodard, Emhardt, Moriarty, McNett & Henry LLP

(57) ABSTRACT

A two-lane ship lock having center-wall tanks that hold water drained from one lane for use in filling the second lane as the unit is operated. The method reduces transit water-use where a lock connects a waterway to a sea with large daily tides by capturing seawater in a lagoon at high tide for use at start of chamber refilling during lower tides.

2 Claims, 4 Drawing Sheets

WATER-SAVING LOCK CONFIGURATIONS AND OPERATIONS

REFERENCE TO RELATED APPLICATIONS

This application claims the benefit of U.S. Patent Application Ser. No. 61/063,434, filed 4 Feb., 2008 and PCT/US2009/031539 filed 21 Jan. 2009, all of which is hereby incorporated by reference.

BACKGROUND OF THE INVENTION

1. Field of Invention

The present inventions relate to designing and operating canal locks to lift and lower vessels, with emphasis on reducing per-transit water-use.

2. Description of Prior Art

A lock is a water-containment chamber—with sealing gates at each end—installed between a lower and an upper waterway. Water is either added to or removed from the chamber to respectively lift or lower the vessel or vessels floating in it. While the engineering, materials and construction of a lock's main components—its chambers, gates, pipes and valves—have notably improved over the millennia, it is still preferable to use gravity to move the water in and out of the lock chambers. Gravity flow has traditionally been preferred over pumping for reasons of efficiency and reliability, as pumps require power to run them and are a source for failure.

At the Panama Canal water is drained in and out of each chamber tens of times a day following 100-year-old procedures, demonstrating the reliability of gravity-operated locks. At that canal, a series of gravity-operated locks raise ships arriving from one sea three steps to the level of a lake; after they traverse the canal's lakes and channels across the Isthmus, they are lowered three steps to the other sea by another series of such locks.

The original three-step Panama Canal locks as traditionally operated expend about 98,500 cubic meters (26 million gallons) of Gatún Lake water to raise a transiting ship; and, they use the same again to lower it. For 2003, there were on average 38 transits a day that year; thus, about 7.5 million cubic meters (2 billion gallons) of lake water were used each day. Had the original Panama Canal lock system had only two steps, half-again more water would have been required to transit a ship than what is typically used today. Conversely, had there been four steps, only three-quarters of the water used today would have been needed. Thus, how much water a set of gravity locks uses is strongly tied to its number of steps. However, deciding how many steps to use is best determined by assessing other approaches for reducing water-use, such as recycling, modifying lock layouts and using alternative sequencing of transits. For a lock canal to be successful, a reasonable balance between transits and water-use must be found.

Water to operate the Panama Canal comes from rain. During the tropical rainy season, the present Panama Canal typically receives sufficient water to permit the highest throughput of ships. Only about half the water that falls in the canal's watershed during the rainy season ends up used to lift or lower ships due to storage capacity limitations; some of the excess water is used to generate power, but much goes out to sea unused. Panama Canal transit operations have been curtailed at least once when water was in short supply due to reduced rainfall, which was costly to shippers. Madden Dam (on the Chagres River, above the Canal's main waterway) was added a few decades after the Canal was built to augment the system's water-storage capacity. Nonetheless, water-reserves did fall short fairly recently, validating calls for more improvements to be made. Adding more water-storage capacity to the Panama Canal has been contemplated for decades since Madden Dam was added, still no new dams with reservoirs have been built. Yet, increasing water reserves and devising methods to reduce water-use, continue to be goals for the Canal to assure the system's reliability as demands for service grow.

In addition to time and water-availability constraints that limit the amount of cargo that can be transited, two other present Panama Canal limitations that impact both world shipping and Panama's revenues are that: 1) ships larger than Panamax Class can't transit and 2) canal transits are sharply reduced when locks get overhauled. ("Panamax Class" ships are the largest that physically fit inside the original Panama Canal Locks). To provide larger ships a shorter, more cost effective travel route and to gain revenue from transiting them, adding a larger lane to the Panama Canal has been contemplated for several decades. Having more capacity would also lessen the relative impact to the Canal's revenue stream caused by the periodic overhauls of its locks.

An effort to add a new lane to the Panama Canal is presently underway. Plans are to add side-tank locks of the previous art, with chambers larger than those of the Canal's original locks and which have a water recycling capability. Those locks are to have three tanks parallel to and to one side of each chamber, to and from which water is to be transferred, or recycled, to reduce the system's per-transit water-use; the planned locks will use about 40% of the volume of water a traditionally configured and operated lock uses. For reference, if those side-tank locks were to have two (instead of three) tanks beside each chamber, the per-transit water-use of those locks would be about 50%. With one tank per chamber, water-use would be about 66.7% of a traditionally operated lock.

The method of using such "side-tanks" to reduce lock water-use was introduced several decades before the Panama Canal was built. When the original Panama Canal locks were built, their design included another water-recycling method then available.

Without tanks, that other water-recycling method can reduce the water used per transit of the two-lane Panama Canal lock system to about half of what is traditionally used; the Panama Canal's designers intended for that method to be used during the dry-season. Per that method, half the water drained from a first chamber when lowering its level is directed laterally into the adjacent lane's chamber to begin raising its level; then, only the lower half of the water in the first chamber drains out to the lower waterway and only half the water to fill the adjacent second chamber needs to be drained in from the upper waterway. However, other than tests of the method having been done under the Canal's US Administration, the method wasn't used, as shipping demands apparently did not exceed the system's water reserves with Madden Dam added. Fewer transits and less revenue would have resulted from taking time to save water, only to dump it for lack of storage capacity.

The most critical element of a canal is its ship-lifting system. The lifting device chosen should not only maximize transits for the cost of its construction, but it should minimize the system's overall cost. Beyond the direct costs of design and construction, indirect costs to canal neighbors and to the environment that are generated during and subsequent to the construction effort must be quantified and taken into account.

The concern with the expansion of the Panama Canal is that the plan will add a relatively high-cost, low-return system that will cause excessive and unnecessary impact to third parties and to the environment ad infinitum. That concern prompted the undertaking of an independent investigation of ship lifting systems with the intent of determining whether or not improvements to available technologies could be made.

Mechanical ship lifts were investigated at the outset. That work resulted in the development and patenting of a new mechanical lift capable of handling the world's largest ships, as disclosed in my U.S. Pat. No. 7,354,223.

The assessment of locks that followed has resulted in the development of the new, more efficient lock design and canal operating methods claimed in this document.

SUMMARY OF THE INVENTION

One embodiment of the present invention, with which key features of the invention can be described, is a ship lock for moving a first ship and a second ship between a first and a second waterway. The embodiment comprises a first chamber, located between a first waterway and a second waterway. The first chamber has a first port and a second port leading respectively to the first waterway and to the second waterway for a first ship to pass through. The first chamber is arranged to be in fluid communication with the first waterway and also the second waterway. The embodiment also has a second chamber, which is located between the first and second waterways and in proximity to the first chamber. The second chamber has a third port and a fourth port leading respectively to the first waterway and to the second waterway for a second ship to pass through. The second chamber is arranged to be in fluid communication with the first waterway and also to the second waterway. The second chamber is also arranged to be in fluid communication with the first chamber. The connecting means includes a plurality of pipes with valves connecting the first chamber to the second chamber and also connecting each of the first chamber and the second chamber to the first waterway and to the second waterway. A first tank is proximate to the first chamber and the second chamber. The first tank is arranged to be in fluid communication with the first chamber by the connecting means. The first tank is also arranged to be in fluid communication with the second chamber by the connecting means.

Another embodiment of the present invention is a method of lifting and lowering a first ship and second ship passing through a two-lane waterway lock extending between an upper waterway and a lower waterway with the water level in the upper waterway being higher in elevation than the lower waterway and comprising the steps of providing in a waterway lock, a water recycling tank, a first chamber and a second chamber each with an upper chamber gate that leads to an upper waterway and a lower chamber gate that leads to a lower waterway. Further, a connecting means is provided that includes pipes with valves, with each of the first chamber and the second chamber being connected to each other, to the tank, and to the upper waterway and the lower waterway by the connecting means. The water tank is located between the first chamber and the second chamber to minimize the combined lengths of pipes that connect the tank to the first chamber and the second chamber. A first ship is positioned to move from the upper waterway to the lower waterway in a first chamber that has its lower chamber gate closed and a water level equal to the upper waterway. A second ship is positioned to move from the lower waterway to the upper waterway in a second chamber that has its upper chamber gate closed and a water level equal to the lower waterway. The method includes the steps of closing the upper chamber gate of the first chamber and closing the lower chamber gate of the second chamber; and draining water from the tank into the second chamber by opening a connecting means between the tank and the second chamber until the water levels in the tank and in the second chamber are approximately equal. The connecting means between the tank and the second chamber is then closed. Water is then drained from the first chamber into the second chamber by opening the connecting means between the first chamber and the second chamber until the water level in the first chamber is approximately equal to the water level in the second chamber with the connecting means then being closed between the first chamber and the second chamber. Next, the connecting means between the first chamber and the tank is opened to drain water from the first chamber into the tank until the water level in the tank is approximately equal to that in the first chamber and then the connecting means between the first chamber and the tank is closed. To continue, the connecting means between the first chamber and the lower waterway is opened to finish draining the first chamber to the level of the lower waterway and then the connecting means between the first chamber and the lower waterway is closed. In parallel, the connecting means between the upper waterway and the second chamber is opened to flow water from the upper waterway to the second chamber to finish filling the second chamber to the level of the upper waterway and then the connecting means between the upper waterway and the second chamber is closed. The lower chamber gate of the first chamber to the lower waterway and also the upper chamber gate of the second chamber to the upper waterway are then opened for the first ship and the second ship to pass.

I have determined three ways to reduce the water that locks use to raise and lower ships as follows:

1. Dividing a lift into more steps. Water is reused from step to step when a lift is divided into multiple steps. The volume used is about the fraction obtained by dividing the volume a single tall chamber would use by the number of steps.

2. Gravity-draining water by layers from a chamber being emptied, such that water drained from a layer higher-up in it can be used in refilling a chamber by draining that water to a lower-down layer in it. This is similar to dividing the lift into more steps, but in this case the water, not the ship, is moved to or from in-between "tank-steps" in the process of lifting or lowering ships.

3. Having a transiting vessel inside a chamber every time the chamber is to be filled or drained. Transiting a ship each time maximizes the service provided by the water that is used. To capitalize on this third water-saving method, it is necessary to change the canal's lock unit and channel system arrangement from the conventional and to define corresponding operating procedures.

Disclosed herein is a new lock that recycles water more effectively and a new method of combining the three ways noted above for reducing a multiple-step lock system's water-use, a combination that when used also significantly reduces the intrusion of salt through locks. Additionally, a method for mitigating the effects of significant daily lunar tides to further reduce per-transit water-use is disclosed.

My new lock uses connecting means consisting of pipes with valves that connect to a recycling tank, henceforth referred to as a slave-tank, and to both chambers of a two-lane lock, the chambers of which are themselves interconnected, through the wall separating them, commonly referred to as the center-wall or center-wall structure, also using the connecting means of pipes with valves. The slave-tank is to be strategically placed between the chambers of the lock unit, because of benefits that affords, such as reducing lengths of interconnecting pipes and simplifying structural stiffening against differential settlement. The incorporation of a recycling slave-tank into a two-lane lock, with tank and chambers interconnected in the manner described, permits greater reductions in operating water-use per time expended, with fewer tanks per chamber and less accompanying hardware, than any previous gravity-operated water-saving lock arrangement with tanks.

Using a slave-tank unit avoids or at least significantly reduces problems caused by unequal foundation displacements between tanks and chambers, that are a consequence of each component having a different foundation stiffness, load range, and loading rate. Often seen is cracking of the elements that interconnect components with foundation conditions and loadings that differ markedly; with locks, the pipes between chambers and tanks suffer. Furthermore, a slave-tank lock unit manages waterway level changes more efficiently than a side-tank lock unit because the difference in waterway levels from one operation of the lock to the next are cut in half by the equalization process when water is drained from one chamber to the other.

If one slave-tank is being considered, then it may be worth considering two slave-tanks to provide even more water savings. Two slave-tanks can reduce water-use to about 33.3% (as compared to a traditionally operated lock), whereas one tank reduces water-use to about 40%, yet the time to lift and lower with two tanks is about equal to the time to lift and lower with one. If another two (a third and a fourth) slave-tanks are simultaneously added, water-use can be reduced to about 25%. However, that added pair of tanks would increase operating time. Thus, adding those tanks, and perhaps even more tanks, would have to be assessed for practicality.

When there are significant daily tides, 16 ft tide-cycles twice a day in the case of the Pacific Ocean at the entrance to the Panama Canal, the water stored in recycling tanks when one ship is lowered may fall short of what is needed to later refill the chamber to the same level as the tide is going out. When the tide is coming in, there may be excess water. In either case, recycling methods will lose some efficiency. In the past, use of a separate tidal lock, accompanied by a tidal basin, has been considered to divorce the main locks from the effects such large tidal fluctuations.

The approach for mitigating tide fluctuations disclosed herein uses an additional recycling tide-tank in the center-wall, or uses a shallow lagoon placed beside the lowest chamber of a lock unit, or uses a combination of these, to store water for supplementing that of the recycling process when needed. When more water is needed to fill the seaside chamber because the tide is out, water in this tide management system is used to first fill that chamber to a level between high and mid tides, after which filling and draining of the chambers proceeds normally. The lagoons may be used in combination with a purpose-built tide-tank, or may be independently piped to the chambers.

Water for the tide-tank system may be obtained directly from the sea at high tide, or it may be obtained from any other low-level landside source of draining water, alone or in combination. That choice will be specific to the site and project.

For every recycling tank and for each chamber at steps above sea level, this approach reduces the depth of bottom that each of these containers would otherwise need to effectively manage the tide fluctuations impact up the steps. The savings in lock unit construction obtained by adding a tide-tank system would help to pay for adding it; and, the time saved in water transfers at steps up the locks would help compensate for the extra time it will take to transfer water to and from a tide tank and/or lagoon system.

As an example of the potential benefit of the method, adding water from a tank or lagoon first when filling the presently planned side-tank lock's seaside chamber would reduce the water used by as much as 7% at the Pacific entrance to the Panama Canal.

Germany's Havel Kanal locks at Hohenwarthe have two lanes and one step, as do the Panama Canal Locks at Pedro-Miguel. If ships were to routinely transit those locks in both directions continually, such that a ship traveling the other way is always there to take the place of a ship that exits a chamber, both of those single-step lock units could be operated using half the water they "normally" use. That water-use reduction cannot be obtained at multiple-step locks with steps that are contiguous.

Disclosed herein is the method of purposely separating all the steps that a lock set with multiple-steps has to make it possible to cut a lock canal's water-use in half relative to a canal that has a multiple-step lock set with contiguous steps, all else being equal.

The method of separating steps, in effect, allows all three of the available water-reducing techniques noted earlier to be combined in a multiple-step lock, where prior multiple-step locks have only combined two of those techniques.

Furthermore, separating steps also allows three methods for reducing the amount of salt that intrudes through locks to be combined. As is discussed in more detail later in this document, the more concentrated salt mixture that intrudes through locks when water is recycled to and from the chambers during ship-lifting operations can be more effectively counteracted by combining the three methods to reduced salt intrusion volumes than is possible with locks that are more conventionally arranged.

DESCRIPTION OF THE PREFERRED EMBODIMENTS

Figure 1A:
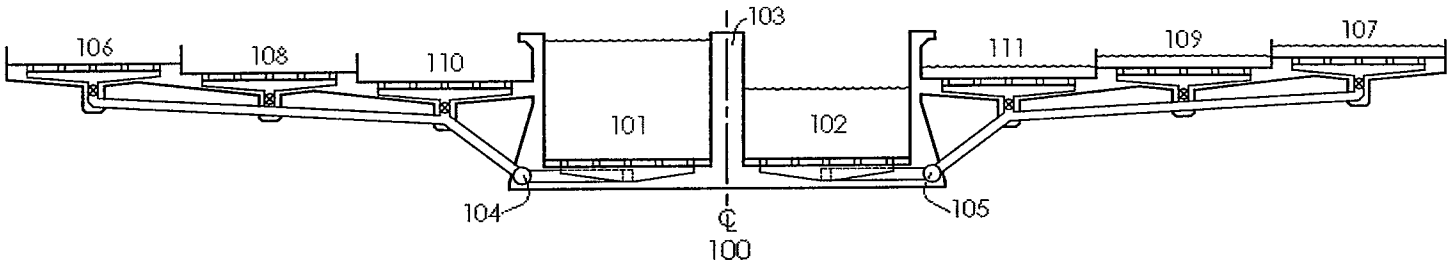
Prior Art Fig. 1A
FIG. 1A is a cross-sectional end view of a prior art, two-lane, three-side-tank-per-chamber water-saving lock layout.

For the purpose of promoting an understanding of the principles of the inventions, reference will now be made to the embodiments illustrated in the drawings and specific language will be used to describe the same. It will nevertheless be understood that no limitation of the scope of the inventions is thereby intended, including such alterations and further modifications to the illustrated devices, and such further applications of the principles of the inventions as illustrated therein being contemplated, as would normally occur to one skilled in the art to which the inventions relate.

The devices, system arrangements, and operating methods described herein allow the water volume used by a hydraulic ship lift, commonly referred to as a lock, to be reduced in ways that differ with respect to how previously available lock designs were operated and in what could previously be done using system arrangements and operating methods applicable to the lock designs then available.

As water is usually used to power locks and the cost of power is rapidly rising, the slower, more efficient and costlier locks and canal arrangements presented herein, which use far less water-power per ship transited than conventionally arranged locks use, will become increasingly attractive options to consider in planning future lock systems.

In addition to reducing water-use, an alternative canal system arrangement and operating method that is presented herein allows reducing the amount of salt that intrudes into freshwater, for when an inland waterway is connected to an ocean.

While protecting freshwater resources is becoming increasingly important, a viable method to remove salt that intrudes through traditionally operated locks continues to be elusive. Thus, the methods to reduce the amount of salt that intrudes through locks presented herein will undoubtedly gain popularity.

New Water-Saving Lock Layout

Figure 1B:
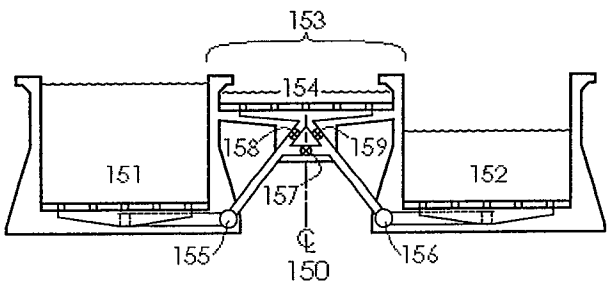
FIG. 1B is a cross-sectional end view of the first alternate embodiment of the present invention and shows a two-lane lock layout with one center-wall slave-tank that reduces water-use to the same fraction (40%) as the layout shown in FIG. 1A.

FIG. 1A is a cross-sectional end view of an existing prior art two-lane three-side-tank-per-chamber water-saving lock layout. FIG. 1B is a cross-sectional end view of the first alternate embodiment of the present invention showing a two-lane lock layout with one slave-tank in the center-wall, which can reduce per-transit water-use to the same amount used by the FIG. 1A side-tank layout.

Existing side-tank lock unit 100 shown in FIG. 1A consists of a pair of chambers 101 and 102 separated by center-wall 103. At the base of each chamber's outboard wall are culverts 104 and 105 that connect to ports through the bottom of their respective chambers. Further, there are three side-tanks outboard of each chamber for a total of six side-tanks 106 thru 111, each side-tank having valve-and-pipe sets connecting ports through the bottom of each to the respective culverts 104 and 105. Each lane of existing side-tank lock unit 100 operates independently of the other.

To lower the water level in a side-tank lock's chamber, layers of water are first transferred from the chamber to the stair-stepped tanks beside it, which starts with the topmost water layer flowing into the topmost tank and proceeds down in sequence. For the lock unit 100 depicted in FIG. 1A, each layer drained to a tank represents about $1/5^{th}$, or 20%, of the volume that is to exit the chamber, which means each recycling tank must be sized and shaped, and placed at a practical elevation, for it to receive its layer of water drained to it from the chamber and to later return it, each direction by gravity flow.

The lowering sequence begins by opening the valve between the topmost tank 106 and the chamber 101 and closing it when their water levels equalize. The opening and closing of valves is repeated at each tank down (108 followed by 110) until those three tanks have been filled. Once bottom recycling-tank 110 is full, the water remaining in chamber 101, which is about 40%, is drained to the lower waterway by opening the respective end valve of culvert 104.

To raise the water level in a side-tank lock's chamber, water is first moved into the chamber from the lowest side-tank, then sequentially from the higher tanks.

To start the filling process, the valves between the lowest tank 111 and chamber 102 are opened for water to drain from tank to chamber; the valves are closed when the levels in tank 111 and chamber 102 equalize. That procedure is repeated at each tank up (109 followed by 107) until those three tanks have been drained. Once top tank 107 has been drained, the final, 40%, volume of water needed to finish filling chamber 102 is drained in from the upper waterway by opening the respective end valve of culvert 105.

My new lock's first alternate embodiment is shown in FIG. 1B. Slave-tank lock unit 150 shown in FIG. 1B consists of a pair of chambers 151 and 152 separated by center-wall 153. In the center-wall near the top is slave-tank 154, and to each side near the bottom are culverts 155 and 156 that are connected by transverse culverts to ports penetrating the bottoms, respectively, of chambers 151 and 152. Interconnecting the two culverts are valve-and-pipe sets 157. Additionally, there are valve-and-pipe sets 158 and 159 that connect slave-tank 154 to each culvert, respectively.

When efficiently operated, the lanes of slave-tank lock unit 150 operate together; the water level in one chamber rises while that of the other chamber lowers. As it is with side-tank lock unit 100, the recycling tank of slave-tank unit 150 must be sized and shaped, and also placed at a practical elevation, to receive the water from a chamber layer drained to it and to later return that water to a chamber, each direction by gravity flow. With this single slave-tank embodiment there are two operating sequences that could be followed, each sequence having its practical elevation for the tank that stores the layer of water transferred to and from it, and each sequence yielding the same water savings.

One sequence for changing lock unit 150's chamber water levels begins by opening valves 158 between full chamber 151 and empty slave-tank 154 for water to drain until equilibrium is reached between tank 154 and chamber 151 and the valves 158 are closed. That operation moves about $1/5^{th}$, or 20%, of the water being drained from chamber 151 into slave-tank 154, which drops chamber 151's water level about a fifth of the way down.

Next, valves 157 are opened to continue to drain water from chamber 151, but this time into chamber 152, which is at its low level. When chamber levels equalize, valves 157 are closed. That operation moves about $2/5^{ths}$, or 40%, of the water being drained from chamber 151 into chamber 152, which drops chamber 151's water level by two more fifths and, likewise, raises chamber 152's water level by two fifths of the way.

After that, valves 159 are opened to drain slave-tank 154 into chamber 152, and then they are closed when equilibrium is reached. That adds about $1/5^{th}$, or 20%, more fill water to the roughly 40% already added to fill chamber 152.

The final action for chamber 152 is to add the roughly $2/5^{ths}$, or 40%, of the water needed to completely fill it, which is done by opening the valve at the upper waterway end of culvert 156 to flow in the water, after when full the valve is closed.

In parallel, the valve at the lower waterway end of culvert 155 is opened to drain out the roughly $2/5^{ths}$, or 40%, remaining of the total water volume that is expelled from chamber 151 at completion of the operation, after which culvert 155's valve is closed.

Alternatively, the sequence could begin with a full slave-tank 154, located at an appropriate elevation, draining into low chamber 152 the first $1/5^{th}$ of the water needed to fill it. Then full chamber 151 would be drained to chamber 152 until their water levels equalize, which adds about $2/5^{ths}$ more fill water to chamber 152 and lowers chamber 151 by those $2/5^{ths}$. Then chamber 151 would be drained of another $1/5^{th}$ of its water to re-fill slave-tank 154. And finally, each chamber 151 and 152 would be respectively drained of, or filled with, the $2/5^{ths}$ of the water yet to be moved to reach their respective target level changes. The same valves operated in the other operating sequence are operated in this alternative sequence, but in an order that executes these water movements.

In comparison to each other, the side-tank lock unit 100 in FIG. 1A is nearly two-and-a-half times the width of slave-tank lock unit 150 in FIG. 1B, and has 6 recycling tanks to the slave-tank unit's one.

For waterway conditions such as those of the Hohenwarthe, Germany Locks, where the difference in waterway elevations can vary from a minimum of about 11 m to a maximum of about 18 m, a two-lane lock with a single center-wall slave-tank can be configured with an adequately-sized tank placed optimally to perform its water-saving function throughout that range of waterway fluctuations.

As shown in FIG. 1A, the depth of the foundations of the chambers and the various tanks of lock unit 100 are not all the same. Differing depths result in differing foundation stiffness. Added to the assorted foundation depths, the weight of each component varies as water is moved in and out. Those conditions can lead to large bending forces in the pipes that connect the components due to the unequal foundation compression and rebound rates. Either the pipes between the various components must be strengthened to handle the forces generated or the foundation must be stiffened to reduce the movements, or both. Foundation stiffening and pipe strengthening invariably increase unit cost.

The new two-lane slave-tank lock unit 150 reduces the potential problems that the pipes connecting the various tanks to the chambers of a side-tank unit 100 may experience because its components are closer together and can be structurally strengthened with less effort. Thus, the slave-tank unit 150 can at lower cost be built to be less sensitive to changing tank and chamber loads and to differences in the foundation stiffness of each of these components as compared to side-tank unit 100.

Water-saving side-tank locks, and also water-saving two-lane locks with adjacent chambers connected to each other by pipes with valves, have existed for over 100 years. Other ways to reduce lock water-use were sought over those years, but more effective units of consequence apparently were not devised despite several "water-saving" locks having been designed and built in that time.

Therefore, that this independent investigation of ship-lifting systems has culminated in the innovation of the new water-saving slave-tank lock is very satisfying, and it demonstrates the value of taking the time to make such efforts.

Figure 2:
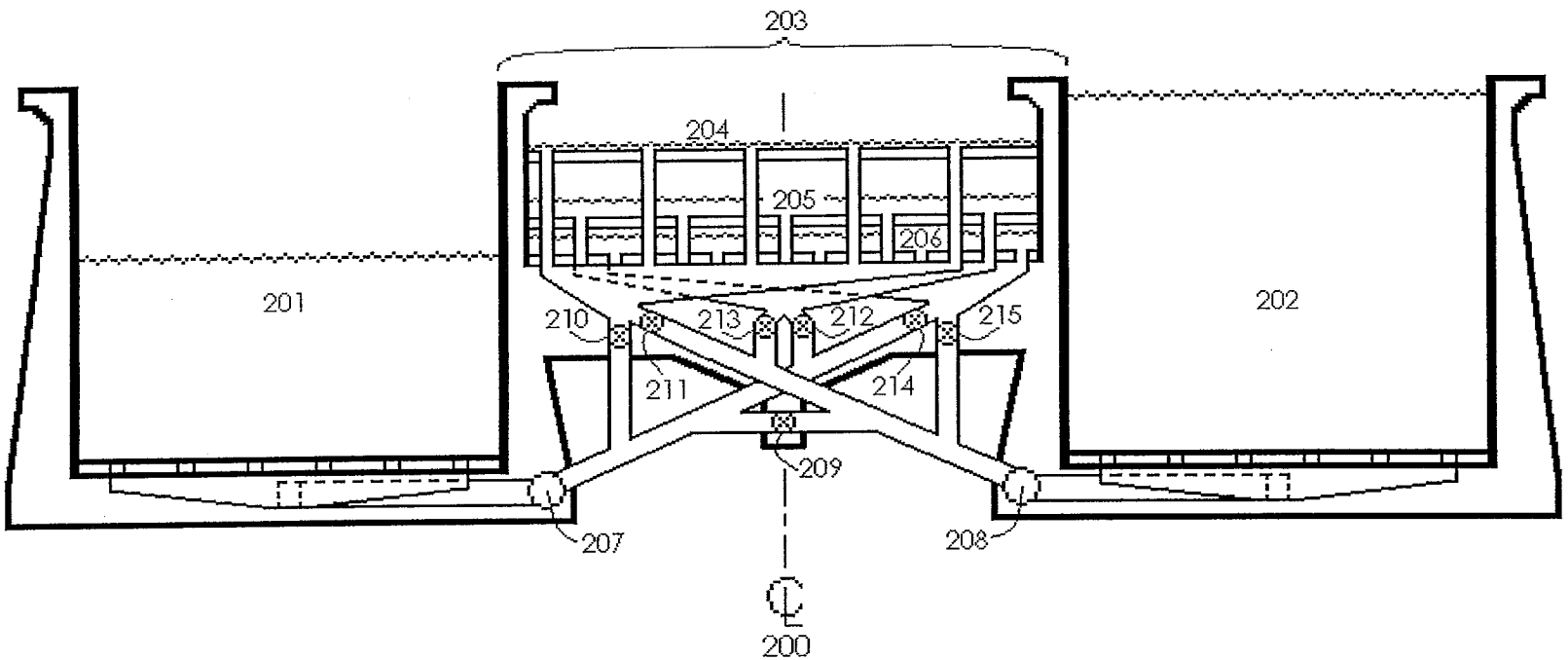
FIG. 2 is a cross-sectional end view of the preferred embodiment of the present invention and shows a water-saving two-lane slave-tank lock layout 200 that includes two slave-tanks, plus an optional tide-tank. My standard slave-tank lock layout has two lanes and only the upper two tanks shown in the figure.

FIG. 2 is a cross-sectional end view of the preferred embodiment of the present invention and shows a water-saving two-lane slave-tank lock layout that includes two slave-tanks plus an optional tide-tank. My standard slave-tank lock layout has two lanes and only the upper two tanks shown in the figure.

The new locks have side-by-side chambers 201 and 202, which are separated by a center-wall or center-wall structure 203; and, that wall is of sufficient width to house an upper slave-tank 204 and a lower slave-tank 205, each sized to perform its water-saving function.

Space permitting, the center-wall could be widened to allow tanks 204 and 205 to be beside one another rather than stacked as shown in FIG. 2. The two recycling tanks of my standard slave-tank unit can be stacked because the chamber "layers" each tank receives water from and returns it to are vertically enough apart that the necessary headroom is available.

Should a slave-tank lock unit connect an inland waterway to an ocean that has significant tides, a third tank 206—referred to herein as a tide-tank, whose main function is to aid in the management of daily tidal fluctuations—may be added. When optimally operated, the tide-tank will further reduce transit water-use.

In center-wall 203, below the slave-tanks and near the bottom, are culverts 207 and 208 (represented by circles) that run the length of the center-wall. Transverse culverts connect these two culverts respectively to chambers 201 and 202 through ports penetrating the bottom of each. Valve-and-pipe sets 209 connect culverts 207 and 208 to each other. Valve-and-pipe sets 210 and 211 respectively connect culverts 207 and 208 to ports in the bottom of slave-tank 204. Valve-and-pipe sets 212 and 213 respectively connect culverts 207 and 208 to ports that penetrate the bottom of slave-tank 205. And when applicable, tide-tank 206 is connected through its bottom to culverts 207 and 208 respectively by valve-and-pipe sets 214 and 215.

Note that valve-and-pipe sets are referred to in plural form as there would likely be several of them along the lock's length.

As noted previously, a recycling slave-tank must be sized and shaped, and positioned at a practical elevation, to receive the layer of water drained to it from a chamber and to later return it, each direction by gravity flow. The upper tank 204 and the lower tank 205 are to handle about $1/6^{th}$ of the water volume that is in total moved in and out of the each chamber during lock operation and they must be designed accordingly.

Tide-tank 206, used to manage tide fluctuations, is positioned near to the level of high tide. When used, the tide-tank supplies water to either chamber at the start of the filling operation when the tide has dropped below the level of the water in that tank. Slave-tank system operation would proceed "normally" after the water from the tide-tank has been added to the chamber being filled. That chamber pre-filling minimizes the negative impact that significant tides have on lock water-savings, and actually increases the savings. Specific site conditions and operating needs will determine how big to build the tide-tank.

At the near and far ends of culverts 207 and 208 shown in FIG. 2 are valves; one end of the culverts will be referred to as being at the lock's high-exit end and the other at the lock's low-exit end, respectively referring to the upper and lower waterways that the locks connect. The culvert end valves are used to allow water to flow into the chamber from above its high-exit end and to allow it to flow out to either the next chamber down or to the waterway beyond its low-exit end.

Previous to the new slave-tank design, a two lane lock unit having parallel adjacent chambers connected by pipes with valves could cut water-use in half, if lateral water-transfer was applied.

If one or more recycling tanks are added to that previous two-lane lock having connected chambers, the slave-tank lock is created. Two tanks, preferably located between the two parallel chambers of that previous lock unit, each connected to each chamber by independent and dedicated pipes with valves create my standard slave-tank lock. The water used per transit by my standard slave-tank lock can be two-thirds of what its predecessor used.

Comparing my standard slave-tank lock's water-use per transit to that of a triple-side-tank lock—such as the Panama Canal Expansion Project is to use—the triple-side-tank lock chamber will use about 1.2 times the water per transit that my slave-tank locks would use, all else being equal and each system being optimally operated.

Note that to operate either my standard slave-tank lock or a triple-side-tank lock requires performing four water-moves to raise or lower the water in each unit's chambers.

By sharing recycling tanks and by transferring part of the water from one chamber to the other, slave-tank locks yield greater savings with fewer tanks. Thus, a slave-tank lock not only uses less water than it's nearest competitor in the same number of moves and in about the same amount of time, it uses fewer tanks and has shorter pipe runs. Therefore, it costs less to build and maintain a slave-tank lock system on a transit-per-lane basis, and using slave-tanks permits a lock system with fewer steps to be considered.

Adjacent and interconnected or piped-together chambers will always be doing the opposite of one-another when the slave-tank lock unit's water-saving operation is being implemented; when the unit operates, one chamber's water level will be rising while the other chamber's water level will be dropping. The ship-transiting situation of the moment will dictate whether or not there is a ship in either of the unit's twin chambers during a given water-transfer operation. For instance, if ships are transiting both lanes one way, one chamber will contain a ship while the other chamber has none. Chamber occupancy will switch from one lane to the other with every transit in the one-way transiting case. If ships are transiting in both directions, both chambers will typically contain a ship when one water-transfer procedure is performed and neither chamber will contain a ship when the next water-transfer procedure is performed. If the lock unit had only one step, and if there were ships going both ways seeking transit, both chambers could contain a ship at every operation, which really saves water.

For the operation of my standard slave-tank lock that will now be described, it is assumed that ship-traffic is one-way up the locks, which can only be handled in the following fashion:

The transit procedure begins with the ship to be lifted entering chamber 201 (the water in chamber 201 being at low level) through its open low-exit-end gate from a lower chamber or from the lower waterway, after which that gate is closed. At the same time, the ship previously lifted in adjacent chamber 202 leaves that chamber through its open high-exit-end gate to the next lock up or to the upper waterway, after which that gate is closed, as well.

Once ship movements have been completed and gates are closed, the water-transfer sequence can begin. (Note that all valves were left closed when the previous water-transfer sequence ended.)

The first water-transfer step is to drain water from lower slave-tank 205 (which is initially full of water) to begin filling chamber 201 by opening the valves of valve-and-pipe sets 212. Simultaneously, at upper slave-tank 204 (which initially has little water), the valves of valve-and-pipe sets 211 are opened to begin draining chamber 202 (which is initially full) into tank 204 until it fills. Each tank, 204 and 205, receives or delivers about $1/6^{th}$ of the total volume of water being moved in or out of each chamber. When waters no longer flow, the valves of sets 211 and 212 are closed.

The second water-transfer step is to open the valves of valve-and-pipe sets 209 to drain chamber 202 into chamber 201 until water levels in these equalize and valves 209 can be closed. At this step, about $1/3^{rd}$ of the water being drained from chamber 202 is transferred to chamber 201, which is being filled.

The third water-transfer step is to open the valves of valve-and-pipe sets 213 to drain water from chamber 202 into lower slave-tank 205 (which was drained earlier) until that flow stops, and then the valves of sets 213 are closed. Simultaneously, at upper slave-tank 204 (which was filled earlier), the valves of valve-and-pipe sets 210 are opened to drain water from that tank into chamber 201 until that flow stops, and then the valves of sets 210 are closed. Once again, each tank either receives to store about $1/6^{th}$ of the volume of the water being drained from a chamber, or it returns about $1/6^{th}$ to a lower elevation of another chamber during this operating step.

The fourth and final water-transfer step is to open the high-exit-end valve of culvert 207 to add the last $1/3^{rd}$ of the water needed to fill chamber 201, which drains into it from the chamber or waterway above until that flow stops and culvert 207's high-exit-end valve is closed. At the same time, the low-exit-end valve of culvert 208 is opened to drain the last $1/3^{rd}$ of the water from chamber 202 to the chamber or waterway below until that flow stops and culvert 208's low-exit-end valve is closed.

The respective chamber end gates can subsequently be opened to allow ships to exit the filled chamber 201 and enter the drained chamber 202.

When the next ship is in chamber 202, the water-transfer sequence followed to raise it and to lower chamber 201's level will mirror the sequence previously described.

As can be done with the earlier two-lane locks with parallel chambers that are joined by pipes, when slave-tank locks lift and lower ships they can minimize water-use equally whether ships transit both lanes in the same direction or in opposite directions.

At the discretion of the operator, and when doing so is appropriate, the slave-tanks can be left out of the operating sequence to speed-up transits.

The preferred slave-tank lock's operation uses about a third of the water per transit used by a traditional, non-water-saving lock. If slave-tanks are left out of the operating sequence to reduce lock transit time, and only water-transfers between the interconnected chambers are performed, per-transit water-use will increase to about 50%. If saving more time is need, such as during a military emergency, all water-recycling actions can be cancelled.

Thus, the slave-tank system not only offers greater water-savings, it offers several operating options that can be tailored to short or longer term canal operating conditions.

Also, should the chambers of one lane need to be shut down for maintenance, the chambers of the other lane could be operated using the slave-tanks, which would permit reducing the water used to about half that used per transit by a traditional lock. The slave-tanks must be built with extra depth and height in order for that amount of water to be saved during such a single-lane operation. If the system were to be built in phases, that extra tank depth and height would likewise be needed in order to cut water-use in half when operating the unit's first completed lane.

Typically, for water-saving techniques to be effective it is best to keep upper and lower waterway level fluctuations relatively small, perhaps at less than 10% of the lock step-height. Should there be large tidal fluctuations, such as those occurring daily at the Pacific entrance to the Panama Canal, a method to manage such fluctuations (involving the use of optional tide-tank 206) is provided and is discussed in conjunction with FIG. 3.

To facilitate slave-tank lock maintenance it is recommended that devices with which to plug pipes be added at key locations, such as to either side of the valves of sets 209 and at the slave-tank terminus of all valve-and-pipe sets connecting to them. Such plugs would permit maintenance on half of the valve and pipes sets during the overhaul of a chamber while permitting the open lane to be operated with slave-tanks included.

Also, the slave-tank unit's recycling tanks may be given maintenance while both lanes are operated, sharing water between chambers to save about 50%, provided that appropriate plugging devices are included in the design.

A one-lane operation, which saves about 50% the water, is performed as follows:

Beginning with a ship being lowered in chamber 202, once a ship has entered the high-exit-end of the chamber and the gate at that end has been closed, the valves of valve-and-pipe sets 211 are opened to drain water from that chamber into upper slave-tank 204. About one-quarter of the water in chamber 202 will have been drained. When that flow stops the valves of sets 211 are closed.

Next, the valves of valve-and-pipe sets 213 are opened to drain about another quarter of the water from chamber 202 into lower slave-tank 205 until that flow stops and valves 213 are closed.

Finally, the valve at the low-exit end of culvert 208 is opened to drain the remaining half of the water from chamber 202 to the lower waterway or lock chamber below. When flow stops, culvert 208's low-exit-end valve is closed and the chamber's lower-exit gate is opened for ships to pass through.

Once the ship is out of the chamber (and another one replaces it, if applicable), the gate is closed and water is drained back into chamber 202, first from lower slave-tank 205, then from upper slave-tank 204, and finally from the waterway or chamber above through the high-exit end valve of culvert 208, each operation effected by opening and closing the respective slave-tank and culvert high-exit-end valves in proper order.

Thus, operating only one lane of my standard slave-tank lock unit is much the same as operating a side-tank lock unit that has two side-tanks per chamber.

Figure 3A:
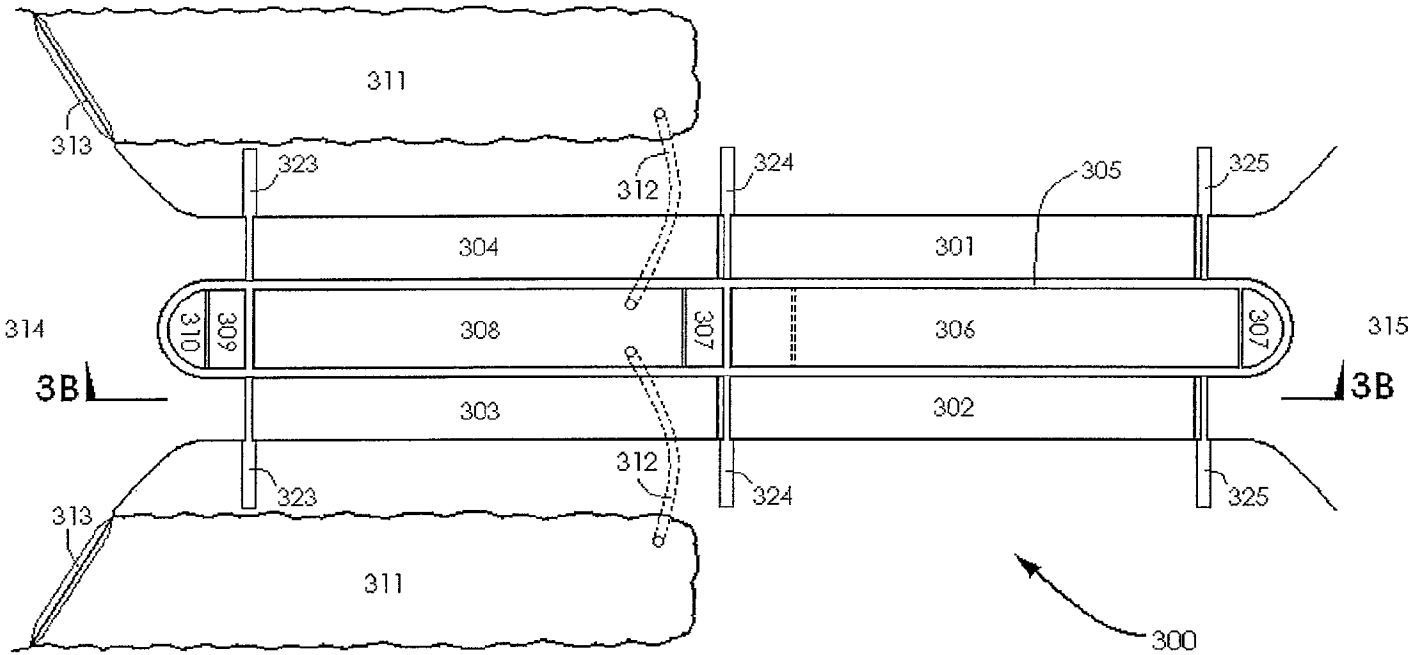
FIG. 3A is a plan view of the second alternate embodiment of the present invention and shows a lock unit with two contiguous steps, each step comprised of a slave-tank lock of my standard layout. It also shows shallow lagoon(s) that may accompany the optional tide-tank located in the lock unit's lowermost step.
Figure 3B:
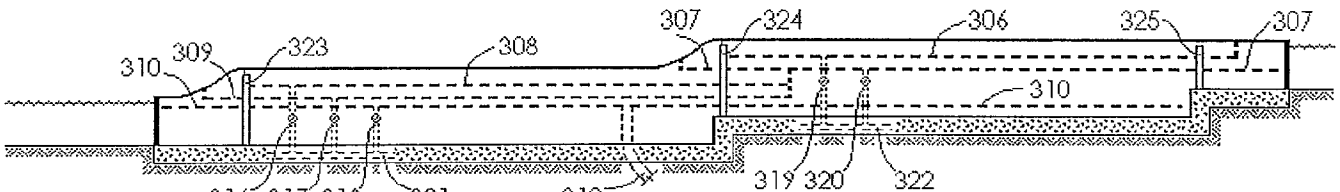
FIG. 3B is a cross-sectional side view taken along the line 3B-3B of FIG. 3A and viewed in the direction of the arrows, depicting with hidden lines a possible arrangement of slave-tanks within that two-step lock unit's center-wall.

FIGS. 3A and 3B are respectively a plan view and a cross-sectional side view of a two-step slave-tank lock unit, representing the second alternate embodiment of the present invention, illustrating how a multiple-step slave-tank unit might be configured. FIGS. 3A and 3B also depict the tide-tank that was introduced in FIG. 2; they show how that tank, and shallow tidewater lagoons that could accompany it, may be incorporated. The method for mitigating tides will be discussed shortly.

Insofar as creating multiple-step slave-tank lock units, there is no limit to how many steps might be contemplated so long as doing so is practical; the stepwise linking of several units is no different than for conventional designs. Other than for the water movements between chambers and tanks that occur behind the scenes, a slave-tank lock unit operates in much the same way as a conventional two-lane lock unit.

Ships that transit the two lanes of this slave-tank lock unit can all go in the same direction or they can go one way in one lane and the other way in the other. But, relative to a conventional lock unit, the number of transits of this slave-tank unit in a given time frame will be less. True for all water-saving locks, manipulations to reduce water-use increase transit time. That in turn permits fewer transits per unit of time.

New Water-Saving Tide Mitigation Method

FIG. 3A is a plan view of the second alternate embodiment of the present invention and shows a two-step slave-tank lock unit 300—located between lower and upper waterways 314 and 315—depicting the shallow lagoons 311 that accompany optional tide-tank 310 in the lowest step of a lock system. The tide-tank and lagoons are used to capture, for example, high tide water (entering through the seawall and weir structures 313) to supply initial fill-water to the lowest step's chambers during periods of lower tide.

FIG. 3A shows the locations of upper-step chambers 301 and 302, and lower-step chambers 303 and 304, of this two-step lock unit. The unit has upper and lower slave-tanks 306 and 307 within center-wall 305 at the upper step, plus upper and lower slave-tanks 308 and 309 within center-wall 305 at the lower step, in addition to tide-tank 310 noted earlier. The two-step lock unit also has three sizes of gates: gates 323 at the seaway, gates 324 between steps, and gates 325 at the upper waterway.

Seawall and weir structures 313, placed between lagoons 311 and the lower waterway, are shown on FIG. 3A, as well. The lagoons are connected to tide-tank 310 (within center-wall 305) by pipes 312 that cross beneath chambers 303 and 304.

FIG. 3B is a cross-sectional side view taken along the line 3B-3B of FIG. 3A and viewed in the direction of the arrows, depicting with hidden lines an arrangement of the slave and tide tanks within that two-step lock unit's center-wall. As they hold water at different levels, the tanks can be overlapped to compact the lock unit and reduce its cost.

Depicted in FIG. 3B, as well, are valve and piping sets (represented by items 316 through 320), which connect the various tanks to culverts 321 and 322 that run the length of the lock unit within the base of the center-wall.

The lock arrangement depicted in FIG. 3A was chosen as the example with which to discuss the functioning of the titled new method for the reason that it would be a plausible alternative two-step lock arrangement that could be placed parallel to the existing Miraflores Locks for the planned expansion of the Panama Canal. The arrangement saves more water per transit, and also uses existing features of the canal more effectively.

The tide management method was devised to maximize water-savings in the presence of tides, where the idea of the method is to supplement normally recycled water with high-tide water or other water from nearby low-elevation sources stored in a tank at a level near that of high tide. That water would then be used to counter-act the shortfall in fill water occurring when beginning to fill a chamber at a lower tide, else the added fill water would have to be supplied by the upper waterway.

By using the method, the depths of a multiple-step lock's chambers above that at the sea, and also the depths of all of the lock's water-saving tanks, needed by the lock in order to operate its water-saving system, can be reduced, which translates into significant construction savings.

Instead of adding an actual tide-tank, a culvert or other properly designed piping arrangement—sized to accommodate the necessary water movements—may be built as the receiving and distributing element within the center-wall, through which water would flow between chambers and lagoons. Depending on specific site conditions and project requirements, a tide management system may also be adapted to the single-tank slave-tank unit depicted in FIG. 1B.

In the case of the Panama Canal, high tide water may be captured twice a day, plus water from nearby sources, which could include waters coming from other operations related to the canal, will likely be available for capturing.

If there is sufficient area available to fit the size of shallow lagoons needed at that canal's Pacific Entrance, the simplest approach for managing the tide water system is to use only seawater captured at high tide to supply all the water needed at lower tides. For such an approach, the capturing of seawater at high tide is accomplished using a properly configured seawall and weir system, such as might be found at power generating facility designed to operate using tidal fluctuations.

By employing the high-tide water capturing approach, the number of water movements performed to empty the chamber does not change from the lock operation previously described in conjunction with FIG. 2. However, during the chamber filling process water is first drained from the tide-tank and shallow-lagoon system before proceeding with "normal" water-transfer procedures.

Alternatively, the first part of the water drained from both lower chambers 303 and 304 during the last step of each chamber's draining process could be directed into the combined tide-tank 310 and shallow-lagoon 311 system. That would allow lagoons of lesser area to be used, but would increase lock water-transfer time and, with that, transit time. Adding to the transit time would be the action of first draining into the tide-tank system the water that will flow to it, followed by the typical releasing of the rest to sea.

The amount of water added to the chamber from the tide-tank system changes as the tide changes. Optimally, the system would be designed such that its water reserves would be nearly depleted by the time the next high tide arrived.

Capturing and storing seawater at high tide in the tide-tank and shallow-lagoon system, and possibly also capturing waters that drain from nearby sources, could be a parallel and independent operation done in support of lock operations.

When there are relatively small tides, slave-tank dimensions can be adjusted, specifically their area can be increased, to dampen out the negative effects of daily tides and maintain water-savings near optimum. At what point it is best to add a tide-tank, instead of adjusting tank sizes, will depend on site-specific conditions and resources.

Figure 4A:
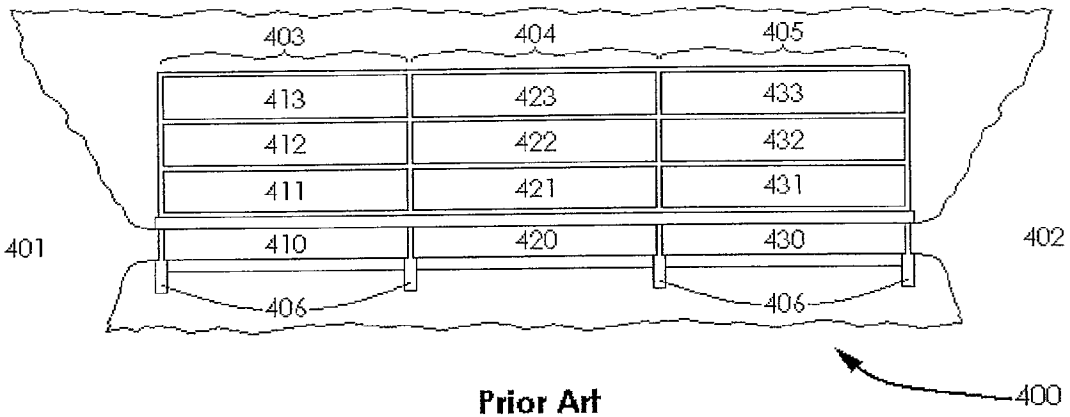
Prior Art Fig. 4A
FIG. 4A is a plan view of a prior art, single-lane lock unit with three contiguous steps placed between a higher and a lower waterway, each step having three side-tanks. This unit is similar in layout to the lock units planned for the Panama Canal expansion.

FIG. 4A is a plan view of a prior art single-lane lock unit 400, which has three contiguous steps plus three side-tanks per step, set between lower and upper waterways 401 and 402. The unit's layout is, similar to that of the side-tank locks slated for use in the expansion of the Panama Canal.

Lowest lock step 403's chamber 410 is accompanied by recycling tanks 411, 412, and 413, which are respectively stair-stepped and connected to it by piping with valves; middle lock step 404's chamber 420 is accompanied by tanks 421, 422, and 423, which are also stair-stepped; and upper lock step 405's chamber 430 has tanks 431, 432, and 433. At each end of the unit and between each chamber are lock gates 406; their sizes vary with respect to their location.

The cross-section of this side-tank lock unit's chambers, with three side-tanks each, is similar to half of the cross-section of side-tank lock unit 100 shown in FIG. 1A.

Figure 4B:
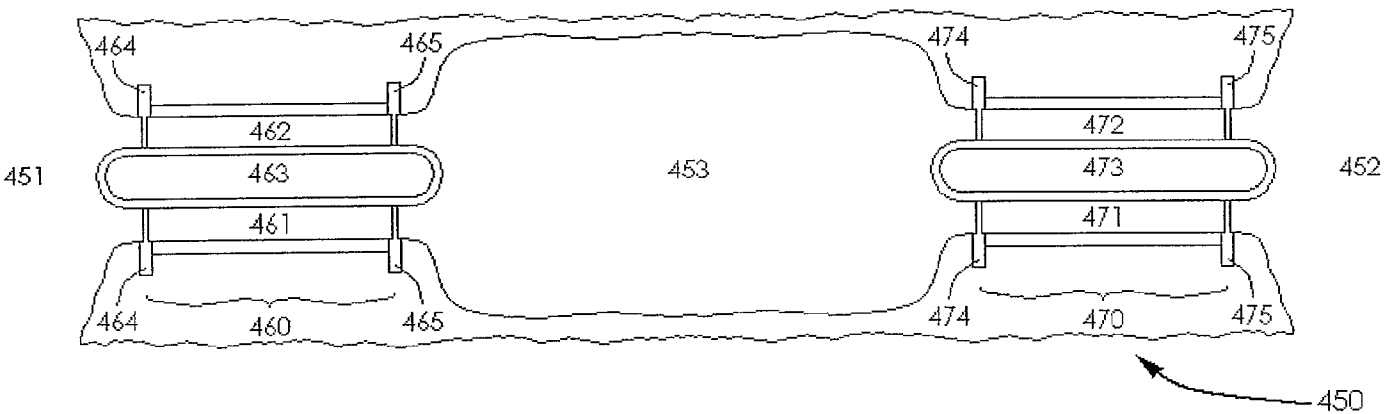
FIG. 4B is a plan view of the third alternate embodiment showing a separated-step lock set, placed between higher and lower waterways, comprised of two slave-tank lock units of my standard layout, separated by a channel in which ships can pass each other.

FIG. 4B is a plan view of the third alternate embodiment of the present invention and shows a two-separated-step slave-tank lock set 450, placed between lower and upper waterways 451 and 452, that expends significantly less water per transit than the three-contiguous-step side-tank unit 400 and also permits far less salt to intrude should these locks connect a waterway with fresh water to an ocean. The set is comprised of two of my standard slave-tank lock units 460 and 470 separated by a short channel 453, within which ships traveling the canal in opposite directions can pass to reduce water-use.

Lower lock unit 460 is comprised of chambers 461 and 462 that are separated by center-wall structure 463, which houses the slave-tanks, and has an associated tide-tank or lagoon should waterway 451 be a tide-affected ocean. The unit has a taller pair of gates 464 to the lower waterway 451 and a shorter pair of gates 465 to channel 453.

Upper lock unit 470 is comprised of chambers 471 and 472 that are separated by center-wall structure 473, which contains the slave tanks. The unit has a taller pair of gates 474 to channel 453 and a shorter pair of gates 475 to the upper waterway 452.

The two separated slave-tank units 460 and 470 of system 450 can—in two steps—lift and lower vessels between the same waterways of three-step side-tank lock unit 400, but can do so using about 62.5% the water used by unit 400 per ship transited.

Separating the steps with channel section 453 for ships to pass each other between steps permits the per-transit water-use to be cut in half.

Cutting water-use in half applies to any lock set or system with separated steps, irrespective of lock type, assuming that the system is appropriately operated.

By happenstance, there exists a separating "channel" in the Panama Canal, where the Miraflores Locks are separated from those at Pedro-Miguel by about a mile-and-a-half stretch of Miraflores Lake. The Panama Canal separated-step example, which is traversed many times a day, every day of every year, demonstrates that such an arrangement not only exists, but it is operationally manageable.

Ship-by-ship lane reversals occur on occasion at Pedro-Miguel locks due to ship scheduling, but not for the reason of saving water; below Pedro Miguel, the locks at Miraflores need the full volume of water to operate, so it is fruitless to save water at Pedro Miguel as more water must still be delivered to operate Miraflores Locks.

To clarify the 62.5% water-use comparison figure noted above, the following explanation of how the noted percentage is reached is offered:

The triple-side-tanks of the single-lane unit 400 reduce the water used to operate its chambers to two-fifths—or 40%—of that used by a traditionally operated chamber. 20% of the chamber's operating water is stored in each of the three side-tanks for re-use; and, 40% of the chamber operating water is expended per transit.

In order to compare the three-step unit 400 to the two-step set 450 (comprised of two single-step units), it is necessary to relate these to a common point of comparison, which is here defined as a tall, single-step lock connecting the upper and lower waterways.

To convert water-use rates to the common comparison point it is necessary to divide the 40% water volume expended per transit when operating side-tank unit 400's chambers by that unit's three steps. That yields two-fifteenths, or 13.33%, as the unit's water-use fraction relative to a tall, single-step lock's water-use, which is being used as the comparison point.

Set 450 swaps water in and out of tanks and between chambers to reduce chamber water-use to one-third (33.3%). To compare that 33.3% chamber water-use to the noted common comparison point, that percentage must be divided by the set's two steps, and again by two, to account for lane reversals after each transit. Slave-tank set 450's water-use per transit is then 8.33%. 8.33% is 62.5% of 13.33%.

However, unit 400's 13.33% must still be adjusted to account for water expended to reverse its single lane. Single-lane lock unit 400 must be routinely reversed to permit transits in both directions. A load of water that neither lifts nor lowers a ship must be expended with every complete lane reversal cycle; in other words, when the transit direction is switched and later switched back, an extra transit-worth of water is released in the process.

If one considers one reversal cycle a day for the 12 ships it is claimed the Panama Canal's planned single-lane side-tank lock units will transit, the adjusted per-ship water-use for those new locks will be 14.44%. Thus, if reversed daily a separated-step slave-tank lock set 450 would use about 57.7% of the water that the locks Panama plans to build will use per transit. Put another way, 21 transits of a two-separated-step slave-tank lock system can be performed using the same water that performs 12 transits of Panama's planned three-step side-tank locks.

Each lock unit of the separated-step slave-tank lock set 450 would occupy about the same real estate as each step of the side-tank unit 400 would occupy, given chambers of equal size. So, not only does the slave-tank system offer the redundancy of two lanes—transiting nearly twice as many ships with the same water—its units occupy less space.

Furthermore, separating the steps of the lock system with relatively short channel sections allows the application of three techniques to reduce the amount of salt that intrudes from a sea to a waterway of fresh water, while only one can be applied when steps are contiguous. Firstly, some of the saltwater that intrudes through locks can always be drained at the upper waterway immediately beyond the uppermost chamber to reduce what spreads into the upper waterway. By separating the lock steps, that operation can again be done at lower steps using the same water, which significantly increases the salt volume the water expended extracts. Secondly, by always having a ship in the chamber filled, which can only be done if multiple lock steps are not contiguous, the volume of salt available to pass onward through a given lock step is minimized. Thirdly, a short section of channel between steps forces the intruding salt to first dilute into that channel before finding its way into the chamber of the next step up, which results in saltwater of lower concentration in that next step as compared to what moves directly in from a contiguous chamber. When a water-recycling method is used, these salt intrusion "barriers" more effectively counteract the resulting increase in salt concentration as compared to what counteraction can be provided by the progressive dilution process that occurs at each step of a contiguous-step lock having a sharply reduced input of fresh water.

All of the water-use percentages given for the various water-saving locks and systems in the preceding presentation are figures generated for comparative purposes and are based on simplistic, or conceptual, models of each system, which permit descriptions to be more easily followed.

To implement each design, when the details of the time it takes to drain the tanks and chambers are taken into account, changes will be needed that will increase water-use.

For example, while it is known that a recycling tank must in theory be equal in area to the chamber to receive a given layer of water, in practice it must be larger in area. Extra area permits the intended amount of water to be drained while leaving a differential between levels in each container, eliminating the wait for the levels to fully equalize, which would otherwise drag out at an ever-slowing rate.

As designers make adjustments to maximize the transits yielded by the water their locks use, within the confines of the time that is available, there will likely be limited adjustment options to choose from; with respect to this, slave-tank locks offer more options to work with than side-tank locks.

The embodiments shown in this document's drawings incorporate the same essential features. For example, the chambers 461 and 462 (of FIG. 4B) are located between a first waterway 451 and a second waterway 453 with ports 464 that lead to waterway 451 and ports 465 that lead to waterway 453. Thus, chamber 461 is arranged to be in fluid communication with waterways 451 and 453 to allow a first ship to move through the chamber from waterway 451 to waterway 453 and vice versa. Further, chamber 462 is arranged to be in fluid communication with waterways 451 and 453 to allow a second ship to move through the chamber from waterway 453 to waterway 451 and vice versa. Similarly, chambers 471 and 472 are in fluid communication with a first waterway 453 and a second waterway 452. Chambers 151 and 152 of the embodiment shown in FIG. 1B, chambers 201 and 202 of the embodiment shown in FIG. 2, and chambers 301, 302, 303, and 304 of the embodiment shown in FIG. 3A, each of which have an upstream port or gate and a downstream port or gate, are also in fluid communication with two waterways in the same manner as chambers 461, 462, 471 and 472. At least one recycling tank is located between each pair of chambers with the recycling tank(s) connected to both chambers by connecting means that includes a series of pipes and valves to control the flow of water between the tank(s) and chambers. Further, the connecting means connects the chambers together to allow flow of water directly from one chamber to another chamber. The recycling tanks are built into a center-wall structure located between each pair of chambers. All of the embodiments have culverts that run the length of and are parallel with the chambers and center-wall. For example, the embodiments of FIGS. 1B, 3B, and 4B have culverts arranged identically to the culverts 207 and 208 for the embodiment of FIG. 2 which has the culverts positioned in the center-wall 203, below the slave-tanks and near the bottom. Transverse culverts connect these two culverts to the pairs of chambers through ports penetrating the bottom of each. Valve-and-pipe sets connect the culverts to each other and to ports that penetrate the bottom of the slave-tank(s). At the near and far ends of the culverts for all of the embodiments are valves; one end of the culverts being at the lock chamber's high-exit end leading to the upper waterway and the other at the lock chamber's low-exit end at the lower waterways that the lock or system of locks interconnect. The culvert end valves are used to allow water to flow into the chamber from the chamber or waterway above its high-exit end and to allow it to flow out to either the next chamber down or to the waterway beyond its low-exit end. When applicable, a tide-tank is connected through ports in its bottom to the culverts by valve-and-pipe sets 214 and 215.

Likewise the embodiments shown in FIGS. 1B, 2, 3*b*, & 4B enable practicing the same essential steps of the methods described herein. As an example, one of the operating sequences of the single slave-tank embodiment of the present invention depicted in FIG. 1B, noted earlier to have two equivalent operating sequences, can be used to summarize the essential operating steps of the invention. The method of lifting and lowering a first and second ship passing through the sample waterway lock includes the steps of positioning the ships in the pair of chambers and then closing the upper chamber gate of the first chamber and closing the lower chamber gate of the second chamber. Water is then drained from the first tank into the second chamber by opening the connecting means between the first tank and the second chamber until water levels in the first tank and in the second chamber are approximately equal and then closing the connecting means between the first tank and the second chamber. Water is then drained from the first chamber into the second chamber by opening the connecting means between the first chamber and the second chamber until the water level in the first chamber is approximately equal to that in the second chamber, then closing the connecting means between the first chamber and the second chamber. Next, the connecting means between the first chamber and the first tank is opened draining water from the first chamber into the first tank until the water level in the first tank is approximately equal to that in the first chamber and then the connecting means between the first chamber and the first tank is closed. Further, the connecting means between the first chamber and the lower waterway is opened to finish draining the first chamber to the level of the lower waterway; then, the connecting means between the first chamber and the lower waterway is closed. In parallel, the connecting means between the upper waterway and the second chamber is opened to flow water from the upper waterway to finish filling the second chamber to the level of the upper waterway, and then the connecting means between the upper waterway and the second chamber is closed. Last, the lower chamber gate of the first chamber to the lower waterway and the upper chamber gate of the second chamber to the upper waterway are opened for the first ship and the second ship to pass to the first and second waterways, respectively.

When a second tank accompanies the first tank, as in the case of the preferred embodiment of the present invention referred to as my standard slave-tank design (FIG. 2), operations are similar to those of the single-tank embodiment described above with the addition that, when water is drained from the first tank into the second chamber water is at the same time drained from the first chamber into the second tank. After the next step of draining water until equalization from the first chamber into the second chamber, when the process continues with draining the first chamber into the first tank, water is at the same time drained from the second tank into the second chamber. After that, the first chamber is drained to level with the lower waterway while the second chamber is filled to level with the upper waterway.

While the invention has been illustrated and described in detail in the drawings and foregoing description, the same is to be considered as illustrative and not restrictive in character, it being understood that only the preferred and alternate embodiments have been shown and described and that all changes and modifications that come within the spirit of the invention are desired to be protected.

What is claimed is:

1. A ship lock for a first ship and a second ship to move between a first and a second waterway comprising:

a first chamber, having first chamber water therein, located between a first waterway and a second waterway, said first chamber having a first port and a second port leading respectively to said first waterway and to said second waterway for a first ship to pass through;

a second chamber, having second chamber water therein, located between said first waterway and said second waterway, and proximate to said first chamber, said second chamber having a third port and a fourth port leading respectively to said first waterway and to said second waterway for a second ship to pass through;

a first slave tank open to the atmosphere and proximate to said first chamber and to said second chamber, and located to be in fluid communication with both said first chamber and said second chamber; said first slave tank sized and located at an elevation that permits one sixth of the first chamber water in said first chamber being drained during a lock operating cycle to flow out only by gravity to said first slave tank, and that also permits said first chamber water in said first slave tank to subsequently flow only by gravity from said first slave tank to the second chamber being filled during said lock operating cycle;

a second slave tank open to the atmosphere and proximate to said first chamber, and to said second chamber, and to said first slave tank, said second slave tank located to be in fluid communication with both said first chamber and said second chamber; said second slave tank sized and located at an elevation that permits the one sixth of the first chamber water in said first chamber being drained during a lock operating cycle to flow out only by gravity to said second slave tank, and that also permits said first chamber water in said second slave tank to subsequently flow only by gravity from said second slave tank to begin filling said first chamber during the next lock operating cycle;

connecting means extending between said first chamber and said second chamber including a plurality of pipes with valves fluidly connecting said first chamber to said second chamber, and said first chamber and said second chamber to said first slave tank, and said first chamber and said second chamber to said second slave tank, and further connecting each said first chamber and said second chamber to said first waterway and to said second waterway, said connecting means operable to direct water from said first chamber into said first slave tank and vice versa, from said first chamber into said second chamber and vice versa, from said first slave tank into said second chamber and vice versa, and from said first chamber into said second slave tank and vice versa, said connecting means also operable to direct water from said second slave tank into said second chamber and vice versa.

2. The ship lock of claim 1 wherein said second slave tank is lower in elevation than said first slave tank.

* * * * *